United States Patent [19]

Hennink et al.

[11] Patent Number: 5,019,100

[45] Date of Patent: May 28, 1991

[54] USE OF A POLYMER NETWORK, METHOD FOR PREPARING A PREPOLYMER AND ALSO PREPARATION WHICH YIELDS A POLYMER NETWORK AFTER CURING

[75] Inventors: Wilhelmus E. Hennink, Waddinxveen; Leendert Huizer, Zoetermeer, both of Netherlands

[73] Assignee: Nederlandse Organisatie Voor Toegepast-Natuurwetenschappelijk Onderzoek TNO, The Hague, Netherlands

[21] Appl. No.: 214,207

[22] Filed: Jul. 1, 1988

[30] Foreign Application Priority Data

Jul. 1, 1987 [NL] Netherlands ..... 8701548

[51] Int. Cl.[5] ..... A61F 2/16

[52] U.S. Cl. ..... 623/6; 351/160 H; 524/361; 524/505; 525/404; 525/420; 428/264; 428/473

[58] Field of Search ..... 427/389, 392; 524/361, 524/505; 525/404, 920; 623/6; 351/160 H; 428/264, 473

[56] References Cited

U.S. PATENT DOCUMENTS 4,065,598 12/1977 Takahashi et al. ..... 428/384
4,287,323 9/1981 Tefertiller et al. ..... 525/404
4,408,023 10/1983 Gould et al. ..... 525/920 X
4,831,075 5/1989 Traubel et al. ..... 525/404 X

FOREIGN PATENT DOCUMENTS 0167184 4/1984 European Pat. Off. .
2497514 1/1981 France .

OTHER PUBLICATIONS

International Journal of Pharmaceutics, 21 (1984) 277–287, T. K. Law, et al.

*Primary Examiner*—Michael Lusignan
*Attorney, Agent, or Firm*—William H. Elliott, Jr.

[57] ABSTRACT

The invention relates to the use of a polymer network comprising a poly(meth) acrylate which is linked by means of oligomer chains which contain chemically bound ethylene oxide units as hydratable groups, the ethylene oxide units being present in the form of oligomer blocks containing 5/14 200 ethylene oxide units, for coating and/or impregnating a substrate or for manufacturing products such as eye lenses and matrices for immobilizing and/or the regulated release of active substances. The polymer network has improved mechanical properties and a desirable permeability to water or water vapour.

16 Claims, 1 Drawing Sheet

USE OF A POLYMER NETWORK, METHOD FOR PREPARING A PREPOLYMER AND ALSO PREPARATION WHICH YIELDS A POLYMER NETWORK AFTER CURING

FIELD OF THE INVENTION

The invention relates to the use of a polymer network comprising a poly(meth)acrylate which is linked by means of oligomer chains which contain chemically bound ethylene oxide units as hydratable groups.

DESCRIPTION OF THE RELATED ART

The French Patent 2,497,514 describes materials which have a high moisture-absorbing power and are sparingly soluble in water, which materials are obtained by polymerization of a hydrophilic monomer having ethenic unsaturation, for example ethenically unsaturated carboxylic acids and derivatives thereof, in the presence of a difunctional compound, which contains terminal (meth)acrylate groups and which contains blocks of 3–200 ethylene oxide units and blocks of 0–200 propylene oxide units in the chains. These materials, which are termed hydrogels, can be used not only as such for absorbing water but also in combination with other materials such as paper, for absorbing, for example, body fluids.

Networks of the type mentioned in the introduction are known from the publications of Law et al. in Int. J. Pharm., 1984, 21, 277–287 and British Polymer Journal, 1986, 18, 34–36. In these publications, hydrogels are described which are prepared from polyoxyethylene-polyoxypropylene-polyoxyethylene block copolymers (=PEO—PPO—PEO block copolymers) and acrylyl chloride. In this process, a reactive prepolymer is first formed from these two starting materials and this is later linked to form a three-dimensional network in the presence of oxygen with the aid of a standard radical-producing compound. In this process, two different block copolymers are used, namely Pluronic F 68 $(PEO)_{75}$—$(PPO)_{30}$—$(PEO)_{75}$) and Pluronic L 61 $(PEO)_3$—$(PPO)_{30}$—$(PEO)_3$). Mixtures of various quantities of these acrylated block copolymers are linked, hydrogels being obtained which can be used as matrices for the regulated release of, for example, drugs. The characteristic relating to this regulated release is investigated by means of swelling tests in water, water penetrating the matrix, which results in a swollen matrix, in which process dissolved substance (such as a drug) migrates out of the matrix to the water phase.

From U.S. Pat. No. 4,320,221, adhesives are known which consist of (a) the reaction product of an ethynically unsaturated isocyanate, for example 2-isocyanatoethyl(meth)acrylate, and a "polyahl" and also (b) a polymerization initiator and a (c) inhibitor. Polyahl is the term for compounds containing more than one reactive hydrogen atom, for example polyols, polyamines, polyamides, polymercaptanes and polyacids. After these adhesives are cured, structures linked by means of oligomers are formed which ensure a good adhesion between divergent substrates such as metal, plastic and glass. As polyols, use is made, for example, of low-molecular polyether polyols such as tetraethylene glycol. If polyols are used as "polyahls", however, the adhesive preparations described yield structures in which the oligomer chains consist entirely of ethylene oxide units, i.e. the content of ethylene oxide units based on the oligomer chains is 100% by weight.

From a congress publication of Rätzsch et al., Radcure Europe '87, 4–6 May 1987, Munich, Federal Republic of Germany, the coating is known of the separate fibres of textile material with polyethylene glycol acrylates which have been linked to form networks by means of radiation. If the coating preparation is applied in an excessive amount, the sticking of the fibres to each other takes place. Combined with the low strength of the applied coating, this results, however, in damage in the event of mechanical loading. The prepolymers are prepared from acrylyl chloride and polyethylene glycol. The polyethylene glycols used have a degree of ethoxylation of 4–45 and a molecular mass of approximately 200–2000. These prepolymers are readily soluble in water and are therefore applied from a solution in water to the textile material to be treated and subsequently cured. This treatment has a positive effect on the intended properties, in particular the antistatic nature and resistance to dirt.

From a congress publication of Herlinger et al., Radcure Europe '87, 4–6 May 1987, Munich, Federal Republic of Germany, a method is known for rendering polypropylene fibres hydrophilic by means of polyethylene glycol methacrylates. The coatings are fixed to the fibres by seeding. Electron radiation is used for this purpose. It is also reported that adding small quantities of multifunctional linking agents, such as, for example, pentaerythritol tri(tetra)acrylate can increase the degree of fixing to the plastic textile fabrics.

Polymer networks are furthermore known from European Patent Application 0,167,184. In this case a solid substrate which consists entirely or partially of an active substance, for example agricultural chemicals or drugs, is coated with a permeable network based on a water-insoluble (meth)acrylic polymer. Such networks or coatings are prepared by polymerizing a layer of a polymerizable, linkable mixture of (meth)acrylic monomers which is applied to the solid substrate, the presence of nonpolymerizable components such as solvents being avoided. In this manner, a coating with which the release of active substance from the substrate can be regulated is formed on the substrate. Depending on the type of permeable network, this release may be fast or slow.

According to the abovementioned European Patent Application, the polymerization can be carried out by a free-radical mechanism, electron radiation, gamma radiation or UV light being used.

For the known networks, polyfunctional oligomer (meth)acrylates, for example urethane, epoxy, polyester and/or polyether (meth)acrylates are mainly used as starting materials. At the same time, it is possible to include one or more monofunctional polymerizable monomers in the starting material in order to modify the properties of the network or the resulting coating. These compounds copolymerize with the linkable polyfunctional (meth)acrylates and are thereby immobilized in the finished coating. (Meth)acrylic acid, (meth)acrylic acid esters, N-vinyl pyrrolidone, vinyl pyridine and styrene are mentioned as examples of such monofunctional monomers.

From European Patent Application 0,111,360, a coating or film of a copolyether ester is known which has a good water-vapour permeability accompanied by a good impermeability to water. Such a coating is used to render textiles impermeable to water. The copolyether ester consists of a multiplicity of repeating intralinear ester units with a short chain and ester units with a long chain which are bound to each other by means of the ester bonds. The ester units each contain a divalent acid radical of a carboxylic acid having a molecular weight of less than 300. In addition, the ester units having a long chain contain a divalent radical of a glycol having a molecular weight of 800–6000 and the ester units having a short chain a divalent radical of a diol having a molecular weight of less than 250, at least 80% of said diol being 1,4-butanediol or an equivalent compound forming an ester. At least 80 mol % of the dicarboxylic acid used consists of terephthalic or ester-forming equivalent compounds thereof. A polyethylene oxide glycol having a molecular weight of 1000–4000 is in that case used in the ester units having a long chain as the glycol. It is reported that it may be desirable to make use of block copolymers of epoxyethane and subsidiary quantities of a second epoxyalkane.

The polymers according to the lastmentioned European Patent Application are prepared by a standard ester exchange reaction. Preferably, a prepolymer is first prepared from the dimethyl ester of terephthalic acid with a glycol having a long chain and 1,4-butanediol. The resulting prepolymer is subsequently subjected to distillation in order to obtain a polymer with a higher molecular weight, excess diol being removed. This method is termed "polycondensation". From the product thus obtained, films are produced which are subsequently fixed to the porous material to be rendered impermeable to water, for example by heat treatment, mechanically or by means of an adhesive, by blow moulding or extrusion. It has emerged that the coating material according to said European Patent Application has a water-vapour permeability (or "breathing capability") which still leaves something to be desired.

SUMMARY OF THE INVENTION

The invention relates to the use of a polymer network comprising a poly(meth)acrylate which is linked by means of oligomer chains which contain chemically bound ethylene oxide units as hydratable groups, the ethylene oxide units being present in the form of oligomer blocks containing 5–200 ethylene oxide units, for coating and/or impregnating a substrate or for manufacturing products such as eye lenses and matrices for immobilizing and/or the regulated release of active substances.

According to the invention, the blocks containing ethylene oxide units in the network are preferably bound by means of ether, ester and/or urethane groups in the oligomer chains.

Furthermore other aliphatic alkylene oxide units, for example propylene oxide and/or tetramethylene oxide units, are also preferably present in the oligomer chains in the network. It is possible to include other non-water-sensitive blocks, such as polysiloxanes, for example polydimethylsiloxane, in the network. If the oligomer blocks contain less than 5 ethylene oxide units, the water-vapour permeability becomes undesirably low and if more than 200 ethylene oxide units are present, said blocks have the tendency to crystallize, which results in inhomogeneity of the preparation and of the final network. In practice, this range reduces to the abovementioned ethylene oxide content of 10–80% by weight. However, in the case of more than 200 ethylene oxide units, the dimensional stability of the network also becomes low under moist conditions, which is undesirable for the use as a coating.

It may be assumed that the ethylene oxide units, which can also be termed polyethylene oxide, provide for the breathing capability of the network according to the invention. The mechanical properties, such as tensile and tearing strength, are essentially determined by the nature and the quantity of the other oligomer chains. If the network according to the invention is used for coating, for example, textile materials, the properties mentioned are, of course, of great importance.

The length of the oligomer chains which provide for the linking of the polymethacrylate of the polymer network according to the invention is essentially determined by the viscosity requirements which are imposed on a preparation for preparing the polymer network.

If, in the network used according to the invention, the oligomer chains also contain other aliphatic alkylene oxide units in addition to the ethylene oxide units, it is desirable if the blocks of ethylene oxide units in the oligomer chains are interrupted by blocks or units of said other aliphatic alkylene oxides.

The properties relating to the permeability to water or water vapour of the polymer networks can be further modified by also including other types of hydratable groups in the network. Said groups are termed "hydratable polymer segments" because they are present in polymerized form in the network (consequently, as a result of a chemical bonding). N-vinyl pyrrolidone is preferably suitable as hydratable group. The inclusion of said substance in the polymer network according to the invention is advantageous because an additional hydration of the network is possible and said substance contributes to the swellability in water or the permeability to water.

In the networks used according to the invention which are required to have increased resistance to oxidative decomposition a chemically bound antioxidant is preferably present. Such an antioxidant may contain a sterically hindered phenolic hydroxyl group and also a (meth)acrylate group, for example a urethane alkyl (meth)acrylate group. An eminently suitable antioxidant is the compound having the formula 1. This compound is novel.

Formula 1

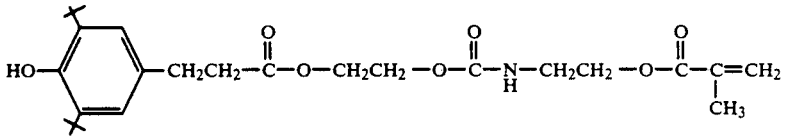

The invention also relates to methods for preparing prepolymers which, after curing, yield the above described polymer networks. For this purpose, a polymer containing ethylene oxide units, such as a hydroxypolyether, is in general allowed to react with (meth)acrylic acid or a derivative thereof such as a (meth)acrylyl halide or isocyanatoalkyl (meth)acrylate.

The hydroxypolyether containing ethylene oxide units may also contain other alkylene oxide units or blocks, for example polytetramethylene oxide or polypropylene oxide blocks.

Commercially available materials, for example Pluronic PE 6200 or Pluronic PE 6400 manufactured by BASF are used as hydroxypolyethers. The said hydroxypolyethers have a molecular weight of approximately 2200 and 3000 respectively.

As reactive (meth)acrylic acid derivative, use is made, for example, of acrylyl chloride or isocyanatoethyl methacrylate.

The invention further relates to a preparation which yields a network as described above after curing. Said preparation is characterized in that it contains:

a) a prepolymer obtainable by the abovementioned methods, and also, optionally, one or more of the following constituents, b) a polymerizable (meth)acrylic derivative such as a urethane (meth)acrylate, c) N-vinylpyrrolidone, d) a polymerizable antioxidant, e) an agent for regulating the viscosity such as a polymer, f) a non-reactive solvent such as water, g) additives such as fillers and colouring agents.

In the method for preparing the preparations which yield the network, the hydroxypolyether may optionally be dissolved in a solvent (which may be aprotic). Acetone or chloroform, for example, is furthermore suitable as solvent. The solution is, however, preferably anhydrous. Stabilizers and/or antioxidants may also be included in the solution. Subsequently, a quantity of reactive (meth)acrylic acid derivative, for example isocyanatoethyl methacrylate (IEM), which is equimolar with respect to the hydroxyl groups in the hydroxypolyether is added to the solution. A catalyst, for example tin salt such as tin(II) octoate or tertiary amines such as triethylamine, may optionally be used in the reaction. After the reaction, the solvent is removed, after which a liquid is left behind which is viscous to a lesser or greater degree. The polymer network according to the invention is formed from said liquid by curing. An important advantage of this method is the formation of a completely colourless liquid, in particular if IEM is used, which may be important for the further use.

It has emerged that the mechanical properties of the polymer network according to the invention can be appreciably improved by the use of, for example, N-vinylpyrrolidone. The N-vinyl pyrrolidone in this case also functions as a reactive solvent.

The improvement of the mechanical properties of the finished polymer material has been confirmed on the basis of tensile strength measurements on films of various mixtures of the prepolymers cured by means of ultraviolet radiation.

A polymer network with particularly good mechanical properties can be obtained by curing a prepolymer which has been prepared from the following ternary system:

the reaction product of isocyanatoethyl methacrylate and hydroxypolyether, the reaction product of cellulose acetate propionate and isocyanatomethyl methacrylate, and N-vinyl pyrrolidone.

In the preparation of prepolymers which can be cured to form polymer networks, use is preferably made of antioxidants which are included in the polymer material by polymerization. According to the invention, a compound containing a sterically hindered phenolic hydroxyl group and also a urethane alkyl (meth)acrylate group, preferably a compound having the structure according to formula 1, is included in the prepolymers from which the networks are obtained, for example as an antioxidant.

It has emerged that such antioxidants stabilize the prepolymers and the networks well. The antioxidant having the formula 1 cannot be removed from the networks by extraction (for example with acetone). This does in fact occur with non-polymerizable oxidants. From this it may be concluded that the antioxidant having the formula 1 is bound to the polymer matrix.

The invention therefore relates also to a compound containing a sterically hindered phenolic hydroxyl group and also a urethane alkyl (meth)acrylate group, preferably a compound having the formula 1.

BRIEF DESCRIPTION OF THE DRAWINGS

FIG. 1 shows how, by adding from 0 to 45% by weight of water to PLURONIC PE 6400-IEM, the swellability of the cured gel can be accurately controlled to from about 38 to about 46% by weight.

FIG. 2 shows how, by adding up to 30% by weight of NVP to PLURONIC PE 6400-IEM, the swellability of the cured gel can be accurately controlled up to about 70% by weight.

DESCRIPTION OF THE PREFERRED EMBODIMENTS

Figure 1:
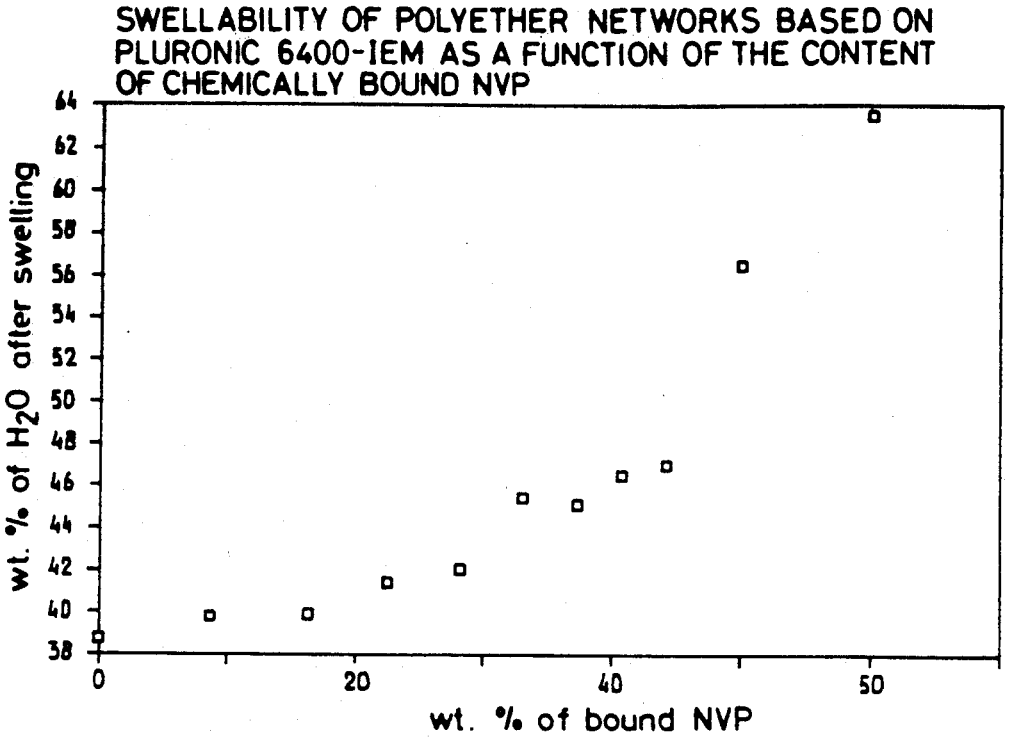
FIGS. 1 and 2 relate to intra-ocular lenses made according to the present invention, as detailed below in Example I, and show graphically how the swellability with water of the lenses can be accurately controlled.

The liquid or the preparation from which the polymer network according to the invention can be formed can be used for coating or impregnating a substrate, for example a textile or leather substrate.

In general, the application of polymer layers to textiles has the consequence that the capability of letting water vapour through is lost to an appreciable extent or completely. In clothing applications (rainproof clothing, sports clothing, protective clothing) textiles having a water-vapour permeability ("breathing") polymer layer or impregnation will make an important contribution to the wearing comfort. Water-vapour permeability is also an advantage in other coated textile products, such as in tents, sleeping bags, upholstery, tarpaulins, packing material and hospital textiles (wound dressings, mats and the like). In addition to a good water-vapour permeability, a high degree of impermeability to water is also required. A coating or impregnation using the network according to the invention meets the requirements mentioned in relation to water-vapour permeability and impermeability to water. In addition, it is desirable that the mechanical properties of the coating or impregnation have an acceptable value, i.e. not only a good tensile strength and tear resistance, but also a certain elasticity is required. A particular aspect of the present invention is that the coating using the cured network forms, on textile materials, a continuous covering layer in which the textile material is to some degree fixed. The coating preparation according to the invention thus coats the entire surface of the textile material and not just the separate fibres, as is the case in the methods and preparations described in the above mentioned publications of Rätzsch and Herlinger. The coatings obtained according to these publications are therefore not impermeable to water.

According to one embodiment of the invention, a coating preparation which yields the network according to the invention is applied to textile fabric by means of spreading, for example with a doctor blade.

The viscosity of the coating preparation will have to have an ideal value depending on the method used for coating. It is therefore advantageous if the coating preparation also contains an agent for regulating the viscosity. It has emerged that, in the case of textile coating, a polymer can be eminently suitable for said purpose also because it can make a contribution to, for example, the mechanical properties of the final coating. The preparation according to the invention can be used without solvents, which may be regarded as an additional advantage. However, it is in fact possible to use solvents.

The means for regulating the viscosity is, for example, polyurethane. Urethanes based on isocyanatoethyl methacrylate are eminently suitable for this purpose because they have a positive effect on the tensile strength and the elongation at rupture of the final coating. In particular, urethanes based on isocyanatoethyl methacrylate and cellulose acetate propionate ester are used.

The invention also relates to a method for coating and/or impregnating a substrate with a preparation described above which, after curing, yields a selectively permeable coating and/or impregnation. For this purpose, a substrate such as textile or leather is treated with the preparation and subsequently cured with the aid of radicals which are produced with the aid of radiation or by decomposition of unstable organic compounds. In this case, electron radiation, gamma radiation or ultraviolet radiation can be used as radiation. Unstable organic compounds which produce radicals by decomposition are, for example, organic peroxides, hydroperoxides or azo compounds. Preferably, UV radiation is used.

The preparations according to the invention are eminently suitable because of their viscosity for application to a substrate by means of spreading.

However, all the methods which are standard in the prior art can be used for applying and curing the compounds according to the invention.

In the case of the manufacture of eye lenses, use is made of a preparation such as described above which contains a quantity of water not exceeding 50% by weight. This quantity of water is of great importance because the swelling behaviour of the cured lens in an aqueous medium can be adjusted with the aid thereof. The swelling behaviour of the eye lens can be used in a beneficial manner in clinical use (implantation). In this connection, the lens is introduced in the unswollen or slightly swollen state into the eye lens sac. After introduction, the eye lens swells in the body fluid and virtually completely fills the eye lens sac. An advantageous property of the eye lens according to the invention is, furthermore, that it also remains deformable to some degree after implantation. As a result, the possibility of natural accommodation is maintained.

In the manufacture of eye lenses, the use of N-vinyl pyrrolidone in the curable preparation also provides an important advantage. This is because the swelling behaviour can be adjusted in a predictable manner by using N-vinyl pyrrolidone even in the case of a relatively large swellability being desired of the cured preparation. This particular aspect of the invention is explained in more detail in the examples.

In the examples the following abbreviations, symbols and commercial names are used:

| | |
|---|---|
| NVP | N-vinyl pyrrolidone |
| CAP | cellulose acetate propionate |
| IEM | isocyanatoethyl methacrylate |
| CAPIEM | urethane of IEM and CAP |
| IONOL CP | 3,5-di-tert-butyl-4-hydroxytoluene |
| IRGACURE 651 | 2,2-dimethoxy-2-phenylacetophenone |
| IRGANOX 1010 | pentaerythritol tetra[3-(3,5-di-tert-butyl-4-hydroxyphenyl) propionate] |
| PHOTOMER 6052 | difunctional urethane acrylate marketed by Diamond Shamrock |
| PLURONIC PE 6400 | polyethylene oxide-polypropylene-oxide-polyethylene oxide with a polyethylene oxide content of 40% by weight, marketed by BASF |
| QUANTACURE BTC | (4-benzoylbenzyl)trimethylammonium chloride |
| VPS 2047 | trifunctional oligomer acrylate, marketed by Degussa AG. |

EXAMPLE I

This example relates to preparing a preparation for manufacturing eye lenses and also to manufacturing an eye lens.

A preparation which consists of 43.8% by weight of PLURONIC PE 6400-IEM, 38.2% by weight of NVP, 15.0% by weight of water, 2.0% by weight of QUANTACURE BTC and 1.0% by weight of antioxidant (formula 1) is introduced into a suitable glass mould (see below). Subsequently, the mould is irradiated for 1.5 minutes with a conventional 2 kW high-pressure mercury lamp. Then the mould is turned over and is irradiated again for 1.5 minutes. The lens formed is removed from the mould and finally irradiated for 15 minutes once again to complete the polymerization. The lens thus obtained is subsequently subjected to the following washing programme:

| Washing liquid | Exposure time (hours) |
|---|---|
| demineralized water | 24 |
| water/ethanol 2/8 (v/v) | 2 |
| ethanol | 2 |
| acetone | 2 |
| acetone/hexane 3/1 | 2 |
| acetone/hexane 1/1 | 2 |
| acetone/hexane 1/3 | 2 |
| hexane | 2 |

Figure 2:
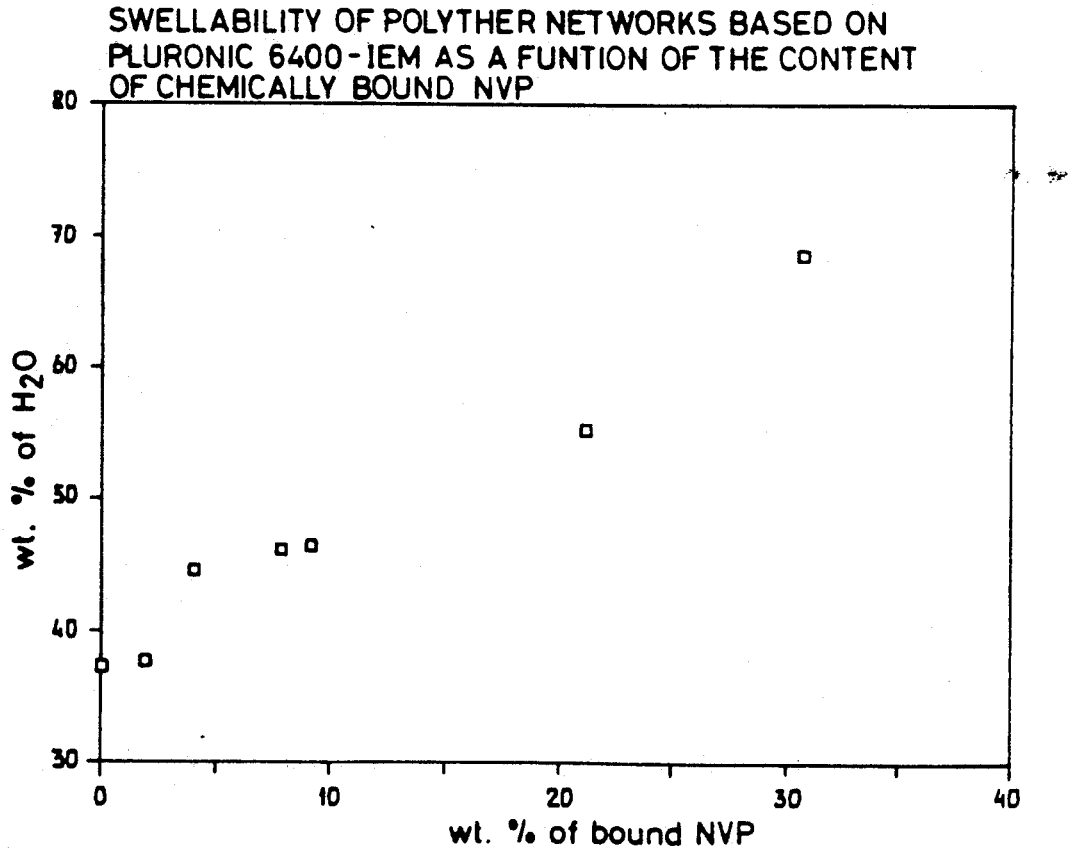

After this washing procedure, the lens is dried for 8 hours. A lens made by the above procedure consists of 55% by weight of water after exposure to water at 37° C. for 24 hours. This swellability can be controlled as follows:

by adding 0–45% by weight of water to PLURONIC PE 6400-IEM, the swellability of the cured gel can be accurately controlled to from 38 to 46% by weight (see FIG. 1). By adding up to 30% by weight of NVP to PLURONIC PE 6400-IEM, the swellability can be accurately controlled to 70% by weight (see FIG. 2).

The preparation for eye lenses contains water, preferably up to 45% by weight, and NVP, preferably up to 40% by weight. The adjustment of these water and NVP concentrations determines, in addition to the swelling behaviour of the cured lens in an aqueous medium, also the refractive index and the dioptre of the lens. This is, of course, of importance in the clinical use of such lenses. The lens is introduced into the eye lens sac in the unswollen or slightly swollen state and is deformable after implantation as a result of the rubbery nature of the lens. As a result of this, on one hand, a complete filling of the lens sac is obtained and, on the other hand, the possibility of natural accommodation continues to be maintained.

DESCRIPTION OF THE MOULD

The mould consists of two glass discs (diameter 3 cm, thickness 0.5 cm). A convex segment is ground out in each disc; diameter 6.8 mm, radius of curvature 5.7 and 4.3 mm respectively. A small inlet and outlet channel is also ground in one disc. The two discs are placed on top of each other in a holder in a manner such that the convex segments form a whole.

We claim:

1. An intra-ocular lens comprising a poly(meth)-acrylate linked by oligomer chains into a polymeric network, said oligomer chains containing chemically bound alkylene oxide units as hydratable groups.

2. An intra-ocular lens according to claim 1 wherein said alkylene oxide units are selected from one or more of the group consisting of ethylene oxide, propylene oxide and tetramethylene oxide.

3. An intra-ocular lens according to claim 2 wherein said alkylene oxide units are in the form of oligomer blocks.

4. An intra-ocular lens according to claim 3 wherein said alkylene oxide is ethylene oxide.

5. An intra-ocular lens according to claim 4 wherein said oligomer blocks contain about 5 to about 200 ethylene oxide units.

6. An intra-ocular lens according to claim 5 wherein said blocks are bound in the oligomer chains by groups selected from one or more of the following: ether; ester; and urethane.

7. An intra-ocular lens according to claim 5 wherein the polymeric network further comprises chemically bound N-vinyl pyrrolidone as a hydratable group.

8. An intra-ocular lens according to claim 5 wherein the polymeric network further comprises a chemically bound antioxidant comprising a sterically-hindered phenolic hydroxyl group and a urethane alkyl (meth)acrylate group.

9. An intra-ocular lens according to claim 8 wherein said antioxidant has the formula

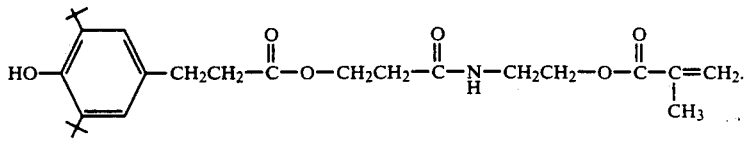

10. An intra-ocular lens according to claim 5 prepared by A) reacting a polymer containing ethylene oxide units including hydroxypolyether with (meth)acrylic acid of a derivative thereof to form a prepolymer and B) curing said prepolymer to form a polymer network.

11. An intra-ocular lens according to claim 10 wherein said (meth)acrylic acid derivative is selected from the group consisting of (meth)acrylyl halide and isocyanatolalkyl (meth)acrylate.

12. An intra-ocular lens according to claim 11 further comprising one or more of a urethane(meth)acrylate, N-vinylpyrrolidone, a polymerizable anti-oxidant, a non-reactive solvent and a coloring agent.

13. An intra-ocular lens according to claim 12 wherein said non-reactive solvent is water.

14. An intra-ocular lens according to claim 12 wherein the curing of the prepolymer is carried out with radicals which are produced with the aid of radiation or by decomposition of unstable organic compounds.

15. An intra-ocular lens according to claim 14 wherein electron radiation, gamma radiation, ultraviolet radiation, organic peroxides, hydroperoxides or azo compounds are used to produce the radicals.

16. An intra-ocular lens according to claim 15 wherein ultraviolet radiation is used to produce the radicals.

* * * * *